US006938364B2

(12) United States Patent
White, III et al.

(10) Patent No.: US 6,938,364 B2
(45) Date of Patent: Sep. 6, 2005

(54) TWO STAGE SNOWTHROWER WITH IMPELLER HOUSING BYPASS

(76) Inventors: Donald M. White, III, 8028 Dakota Ave., Chanhassen, MN (US) 55317; David A. Murray, 608 McFadden's Trail, Eagan, MN (US) 55123; Jerold F. Patrin, 15101 Riverside Ave. North, Marine on St. Croix, MN (US) 55047

( * ) Notice: Subject to any disclaimer, the term of this patent is extended or adjusted under 35 U.S.C. 154(b) by 0 days.

(21) Appl. No.: 10/601,313

(22) Filed: Jun. 20, 2003

(65) Prior Publication Data

US 2004/0255492 A1 Dec. 23, 2004

(51) Int. Cl.[7] ..... E01H 5/09
(52) U.S. Cl. ..... 37/248
(58) Field of Search ..... 37/221, 222, 227, 37/241–243, 246–249, 253, 254, 256, 257, 250, 251; 180/9.2–9.3, 68.5

(56) References Cited

U.S. PATENT DOCUMENTS 5,127,174 A * 7/1992 Takeshita ..... 37/250
5,209,003 A * 5/1993 Maxfield et al. ..... 37/252
6,453,583 B1 * 9/2002 Hanafusa et al. ..... 37/246
6,539,649 B2 * 4/2003 Sueshige et al. ..... 37/245

OTHER PUBLICATIONS

Declaration of Jerold F. Patron—Nov. 23, 2001.

* cited by examiner

*Primary Examiner*—Robert E Pezzuto
(74) *Attorney, Agent, or Firm*—James W. Miller

(57) ABSTRACT

A two stage snowthrower includes snow removal components comprising a transversely extending auger housed within an auger housing. A generally cylindrical impeller housing is joined to a rear wall of the auger housing. A rotatable impeller within the impeller housing rotates within a circular cross-section of the impeller housing to throw snow upwardly through a snow discharge pipe. The snow discharge pipe is offset to one side of the impeller housing such that a first side wall of the snow discharge pipe is longer than a second side wall of the snow discharge pipe. The first side wall of the snow discharge pipe is joined to the circular cross-section of the impeller housing along a first edge where snow is thrown upwardly by the impeller. The circular cross-section of the impeller housing resumes at a second edge which is displaced laterally and below a lower edge of the second side wall.

23 Claims, 11 Drawing Sheets

TWO STAGE SNOWTHROWER WITH IMPELLER HOUSING BYPASS

TECHNICAL FIELD

This invention relates to a two stage snow-thrower. More particularly, this invention relates to the impeller housing of such a snowthrower and the interface between the impeller housing and a snow discharge pipe extending from the top of the impeller housing.

BACKGROUND OF THE INVENTION

Walk behind two stage snowthrowers are well known in the snow removal art. They are called "two stage" because they utilize two powered snow removal elements, namely a snow gathering auger and a snow throwing impeller. The auger extends transversely in an auger housing at the front of the snowthrower. The auger gathers snow on the ground and feeds the snow inwardly to a generally centrally located impeller behind the auger. The impeller rotates at a higher speed than the auger, accepts the snow fed to it by the auger, and throws that snow upwardly in a snow stream through an upright snow directing chute.

The auger housing typically includes an arcuate rear wall having forwardly extending side plates. The auger comprises left and right auger flights secured to an auger shaft. The auger shaft is rotatably journalled between the side plates of the auger housing. The auger flights are shaped so that each auger flight gathers snow from the ground and feeds that snow inwardly towards the center of the auger housing. In other words, one auger flight moves snow inwardly in one direction towards the center of the auger housing while the other auger flight moves snow inwardly towards the center of the auger housing in the opposite direction, i.e. one flight feeds to the left while the other flight feeds to the right.

The impeller is located in a generally cylindrical impeller housing positioned behind the auger housing. The impeller housing and impeller are arranged perpendicularly to the auger housing and the auger. In other words, the auger housing extends transversely on the snowthrower and the auger rotates about a lateral rotational axis. In contrast, the cylindrical impeller housing extends longitudinally on the snowthrower and the impeller rotates about a longitudinal rotational axis.

When looking at the auger housing and impeller housing in a front elevational view, the inlet to the impeller housing from the auger housing is a generally circular opening in the arcuate rear wall of the auger housing. This circular opening corresponds in diameter to the nominal diameter of the impeller housing. Thus, snow gathered by the auger is fed inwardly from each side by the opposed auger flights of the auger until it is pushed through the circular opening forming the inlet into the impeller housing. There, the snow is picked up and thrown as a snow stream by the impeller.

The snow stream is thrown by the impeller through a generally vertical snow discharge pipe having its lower end connected to the impeller housing. The upper end of the snow discharge pipe connects to an upright chute. The chute is rotatable from side to side on the snow discharge pipe. The purpose in rotating the chute is to selectively direct where the snow stream is thrown relative to the snowthrower, i.e. to the front of the snowthrower, to the left of the snowthrower, to the right of the snow-thrower, etc.

The snow discharge pipe is connected to the top of the impeller housing to receive and accept the snow stream being thrown by the impeller. The intersection of the snow discharge pipe and the top of the impeller housing forms an elliptically shaped opening where the circular cross-section of the lower end of the pipe intersects with the top of the cylindrical impeller housing. Generally, the snow discharge pipe is not centered on the impeller housing, but is offset on the impeller housing as shown in FIG. 9.

In most prior art snowthrowers, the distance between the top of the snow discharge pipe and the top of the impeller is quite short, usually only two or three inches. Further, in typical two stage snowthrowers, the snow discharge pipe is straight sided. In other words, the walls of the snow discharge pipe are generally vertical. In certain circumstances, snow being thrown by the impeller clogs or plugs in the snow discharge pipe. A rather solid plug can form comprising almost a solid piece of ice.

In known two stage snowthrowers of this type, it is quite difficult to remove such a plug. There is insufficient room between the plug and the impeller for the plug to fall out as a single piece. Usually, the user has to shut off the engine and come around from behind the handle assembly to where the chute is located. The user then typically uses some type of tool, such as a stick or the like, and sticks such tool down the chute to break the plug into smaller pieces and to push such pieces down through the impeller.

The need to break up and remove plugs in this manner is annoying and inconvenient. The snowthrower obviously can't be operated until the plug is removed, but doing so takes some time and effort. Under certain snow conditions, such as when throwing wet and heavy snow, plugs tend to form frequently. This requires frequent stoppages of the snowthrower and frequent plug clearing operations.

SUMMARY OF THE INVENTION

One aspect of this invention relates to a two stage snowthrower which comprises an auger housing having a transversely extending auger for gathering snow lying on the ground. A cylindrical impeller housing is located behind the auger housing with the impeller housing having a circular cross-section. The impeller housing carries a rotatable impeller for receiving snow from the auger and for throwing snow vertically upwardly in a snow stream. A snow discharge pipe is located on top of the impeller housing for receiving the snow stream from the impeller and for delivering the snow stream to a chute carried on top of the snow discharge pipe. The circular cross-section of the impeller housing is joined to a first side wall of the snow discharge pipe along a first edge such that the circular cross-section of the impeller is interrupted along a first edge. The circular cross-section of the impeller housing resumes at a second edge which second edge is separated by a gap from a lower edge of a second side wall of the snow discharge pipe.

Another aspect of this invention relates to a two stage snowthrower which comprises an auger rotating within an auger housing having an open front. The auger is shaped for feeding snow into an impeller housing. The impeller rotates within a circular cross-section of the impeller housing for throwing snow upwardly through a snow discharge pipe. A gap is provided between a lower edge of a second side wall of the snow discharge pipe and the circular cross-section of the impeller housing for allowing some snow to bypass the snow discharge pipe and not be thrown therethrough.

Yet another aspect of this invention relates to a two stage snowthrower which comprises a transversely extending auger housed within an auger housing. A generally cylindrical impeller housing extends rearwardly from a rear wall of the auger housing. A rotatable impeller is located within the impeller housing. The impeller rotates within a circular cross-section of the impeller housing to throw snow upwardly through a snow discharge pipe attached to a top of the impeller housing. The snow discharge pipe has a first side wall and a second side wall. The first side wall of the snow discharge pipe is joined to the circular cross-section of the impeller housing at a first edge where snow is thrown upwardly by blades of the impeller. The circular cross-section of the impeller housing resumes at a second edge which is displaced laterally and vertically below a lower edge of the second side wall of the snow discharge pipe.

BRIEF DESCRIPTION OF THE DRAWINGS

This invention will be described hereafter in the Detailed Description, taken in conjunction with the following drawings, in which like reference numerals refer to like elements or parts throughout.

FIG. 3 is a perspective view similar to FIG. 2 of a portion of the snowthrower shown in FIG. 1, but illustrating the snow discharge pipe and impeller housing bypass member assembled to the auger and impeller housings but with the auger and impeller removed;

DETAILED DESCRIPTION

Figure 1:
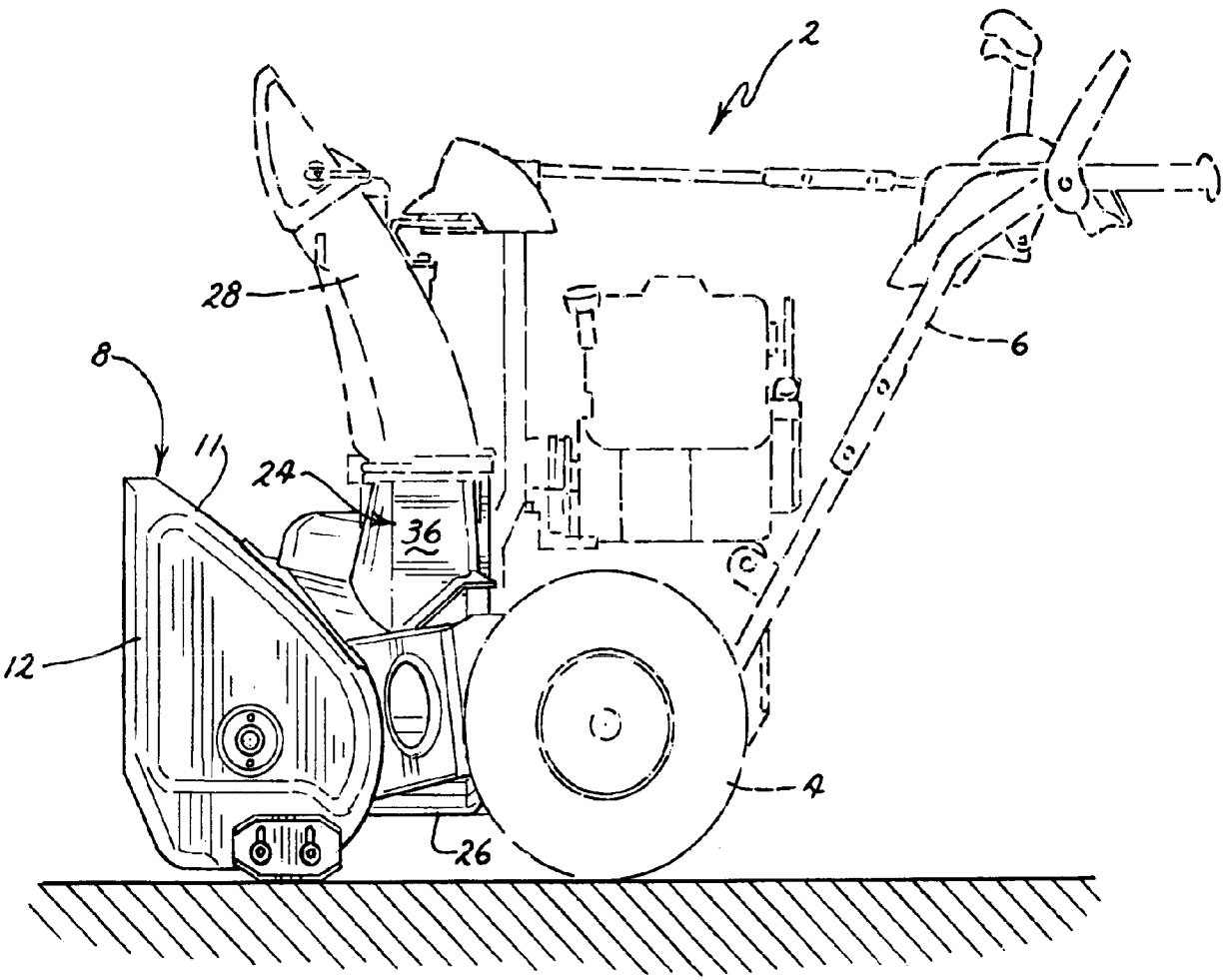
FIG. 1 is a side elevational view of a typical two stage snowthrower according to this invention, particularly illustrating in solid lines the auger housing, the impeller housing and the snow discharge pipe on top of the impeller housing.
Figure 2:
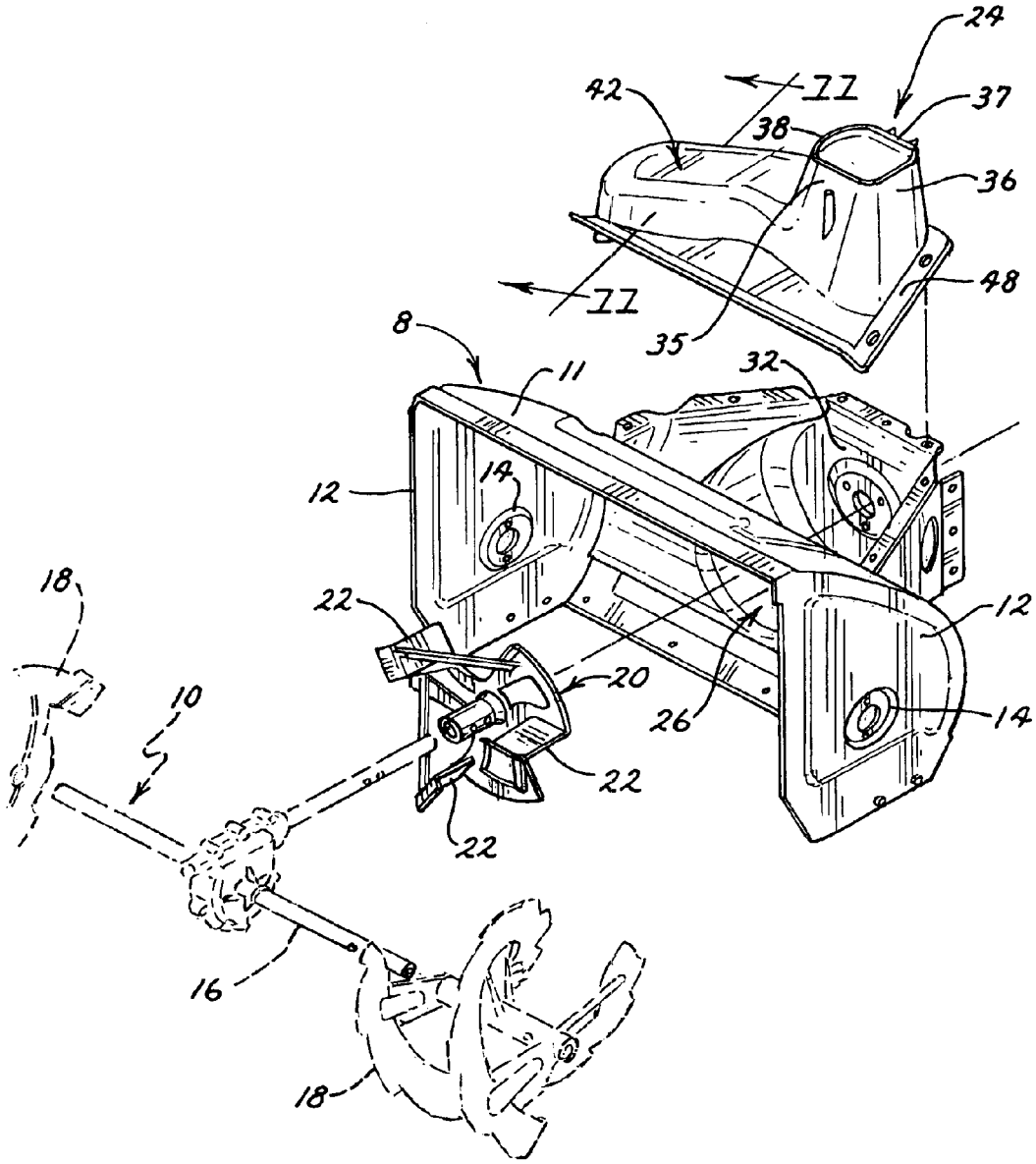
FIG. 2 is a perspective view of a portion of the snowthrower shown in FIG. 1, particularly illustrating the snow discharge pipe and impeller housing bypass member exploded away from the auger and impeller housings and illustrating the auger and impeller exploded out of the auger and impeller housings, all for the sake of clarity.

A walk behind two stage snowthrower according to this invention is depicted generally in the drawings as 2. Referring to FIGS. 1 and 2, snowthrower 2 mounts a pair of rotatable ground engaging wheels 4 that support snowthrower 2 for movement over the ground. Wheels 4 are typically driven from a prime mover carried on the frame, such as an internal combustion engine, to self propel snowthrower 2 over the ground. Wheels 4 could be replaced by ground engaging endless tracks if so desired.

A handle assembly 6 extends upwardly and rearwardly on snowthrower 2 and includes a pair of longitudinally extending hand grips that the user holds while operating and steering snowthrower 2. Various operational controls are provided on handle assembly 6 for allowing the user to selectively engage the self propel system, to selectively engage the snow removal components on snowthrower 2, etc.

The front of snowthrower 2 carries a transversely extending auger housing 8 in which the usual snow gathering auger 10 of a two stage snowthrower is housed. Auger housing 8 includes a curved or arcuate back wall 11 having downwardly depending side plates 12. Side plates 12 include bearings or mounts 14 for rotatably mounting the auger shaft 16. Auger shaft 16 carries two oppositely directed auger flights 18 shaped to move snow inwardly from each side of auger housing 8 towards the center of auger housing 8.

An impeller 20 is located immediately behind auger 10. Again, as is typical in two stage snowthrowers, impeller 20 includes a plurality of blades 22 that accept snow being delivered to impeller 20 by auger 10. As impeller 20 rotates about a longitudinal (fore and aft) axis, blades 22 of impeller 20 throw such snow in a stream upwardly through a snow discharge pipe 24. Snow discharge pipe 24 is fixed on top of the impeller housing 26 offset to one side of impeller housing 26. The usual rotatable snow directing chute 28 is rotatably carried or mounted on top of snow discharge pipe 24.

Figure 4:
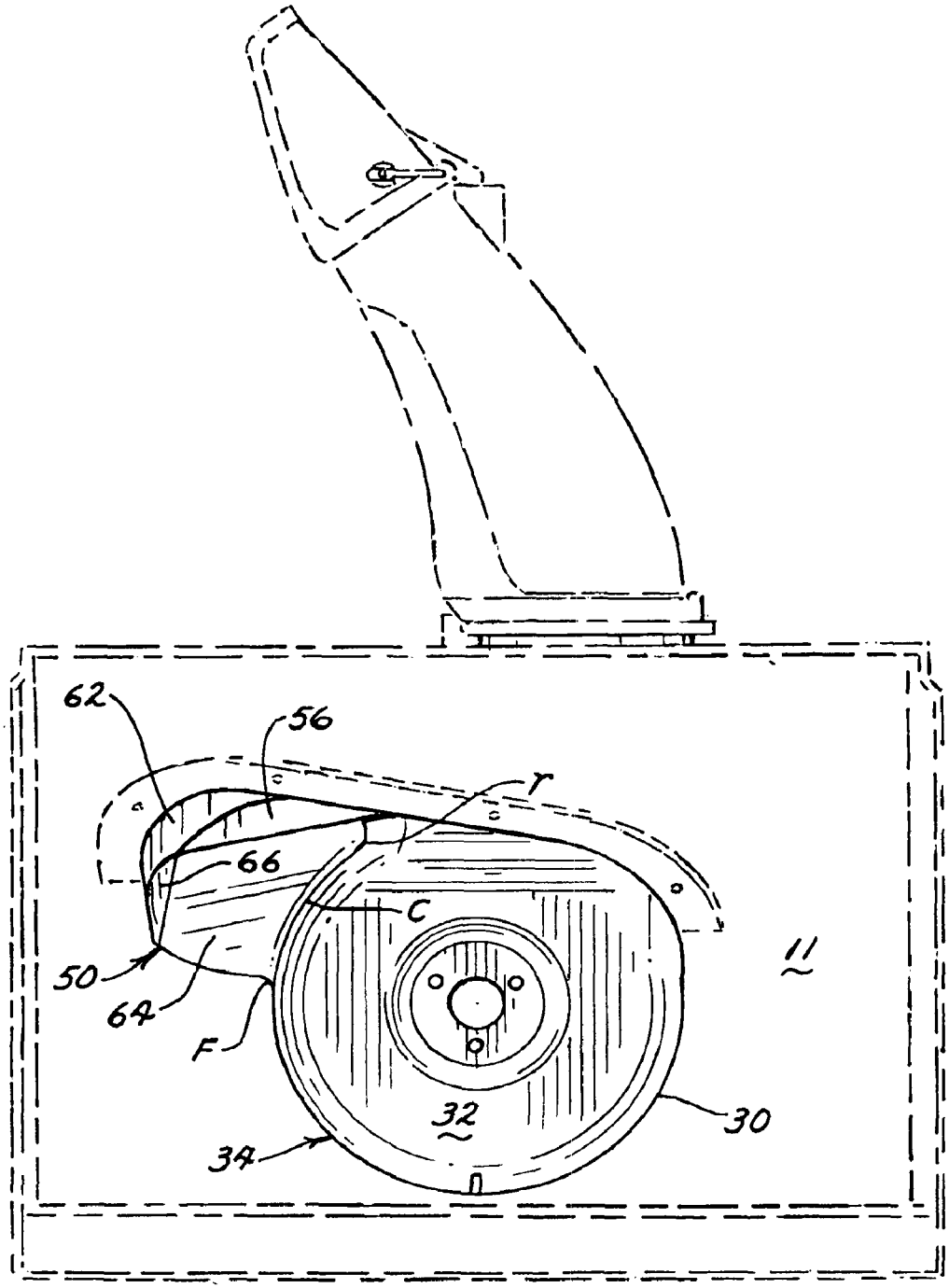
FIG. 4 is a front elevational view of a portion of the snowthrower shown in FIG. 1, particularly illustrating the inlet to the impeller housing in the rear wall of the auger housing as well as illustrating the exit through the rear wall of the auger housing for the bypass passage formed by the impeller housing bypass member.
Figure 5:
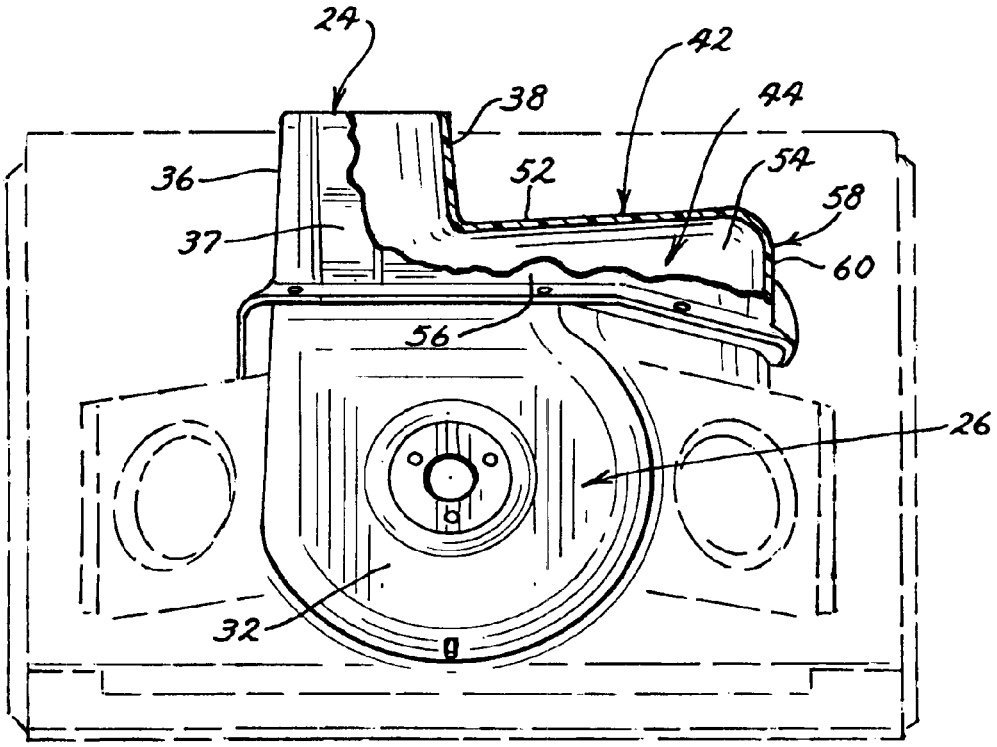
FIG. 5 is a rear elevational view of a portion of the snowthrower shown in FIG. 1, particularly illustrating the impeller housing and the snow discharge pipe and impeller housing bypass member from the rear, a portion of the impeller housing bypass member being broken away to show a portion of the bypass passage.
Figure 6:
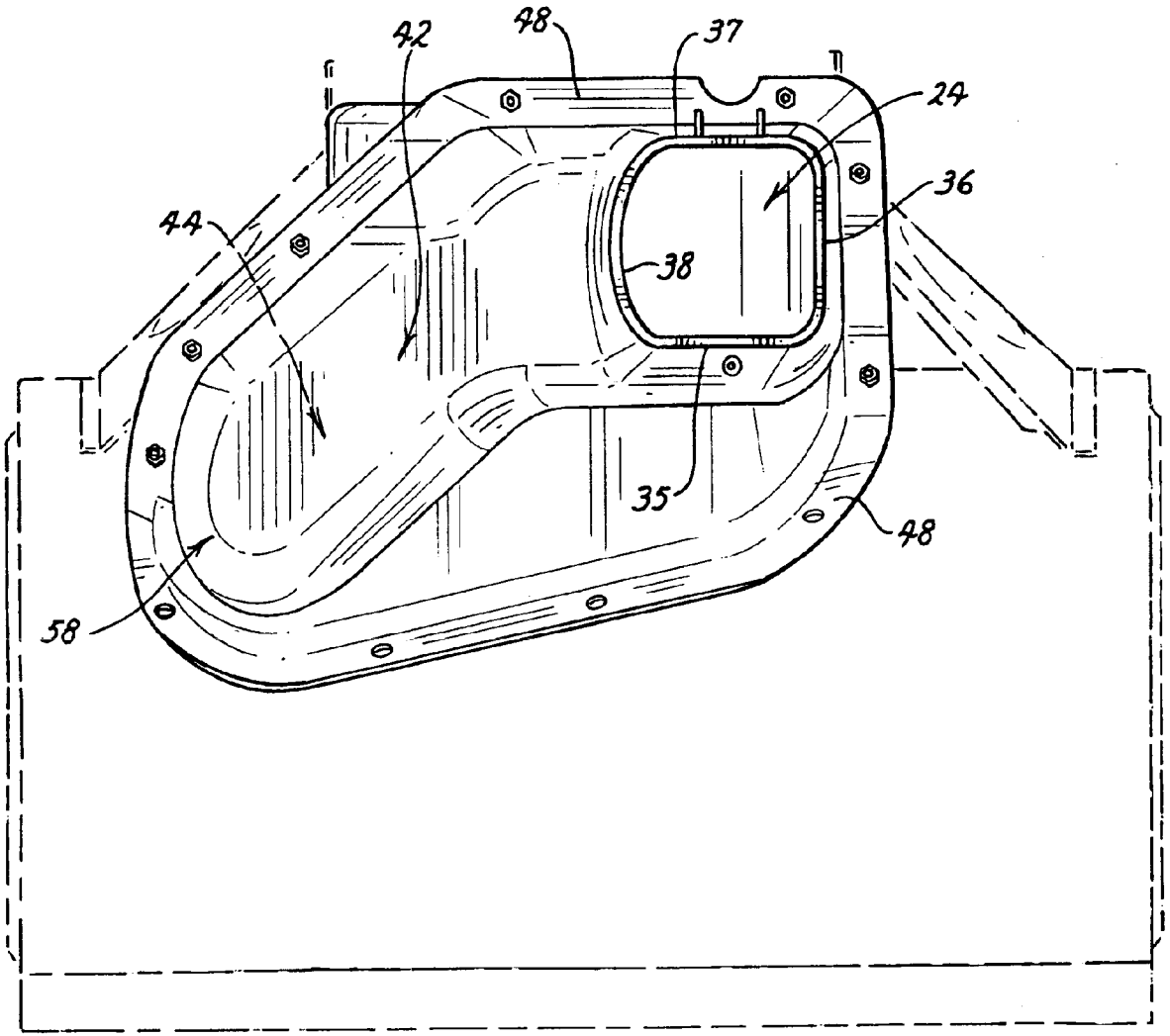
FIG. 6 is a top plan view of the snow discharge pipe and impeller housing bypass member of the snow-thrower shown in FIG. 1.
Figure 7:
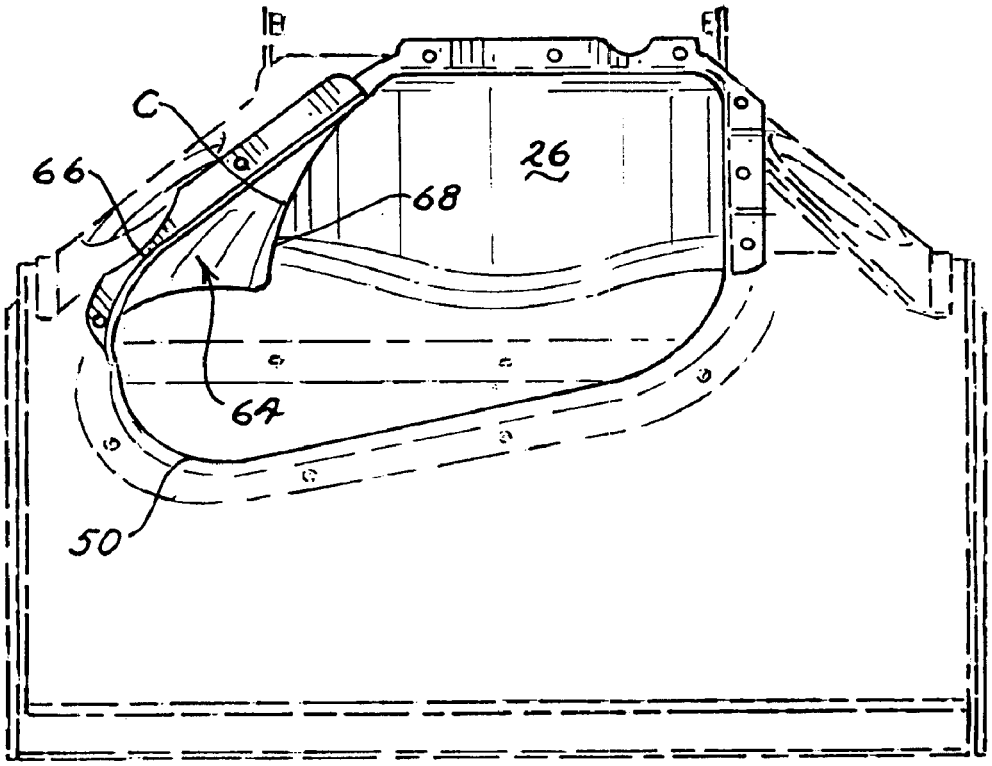
FIG. 7 is a top plan view of a portion of the auger and impeller housings of the snowthrower shown in FIG. 1, particularly illustrating the opening where the snow discharge pipe and impeller housing bypass member intersect with the auger and impeller housings and also particularly illustrating a fixed snow directing baffle between the impeller and auger housings.

A generally cylindrical impeller housing 26 is provided behind auger housing 8 to house impeller 20. As shown in FIG. 4, the entrance to impeller housing 26 is a generally circular inlet 30 in back wall 11 of auger housing 8 corresponding to the diameter of cylindrical impeller housing 26. The rear of impeller housing 26 is closed by a rear wall 32. See FIGS. 2, 4 and 5.

Figure 9:
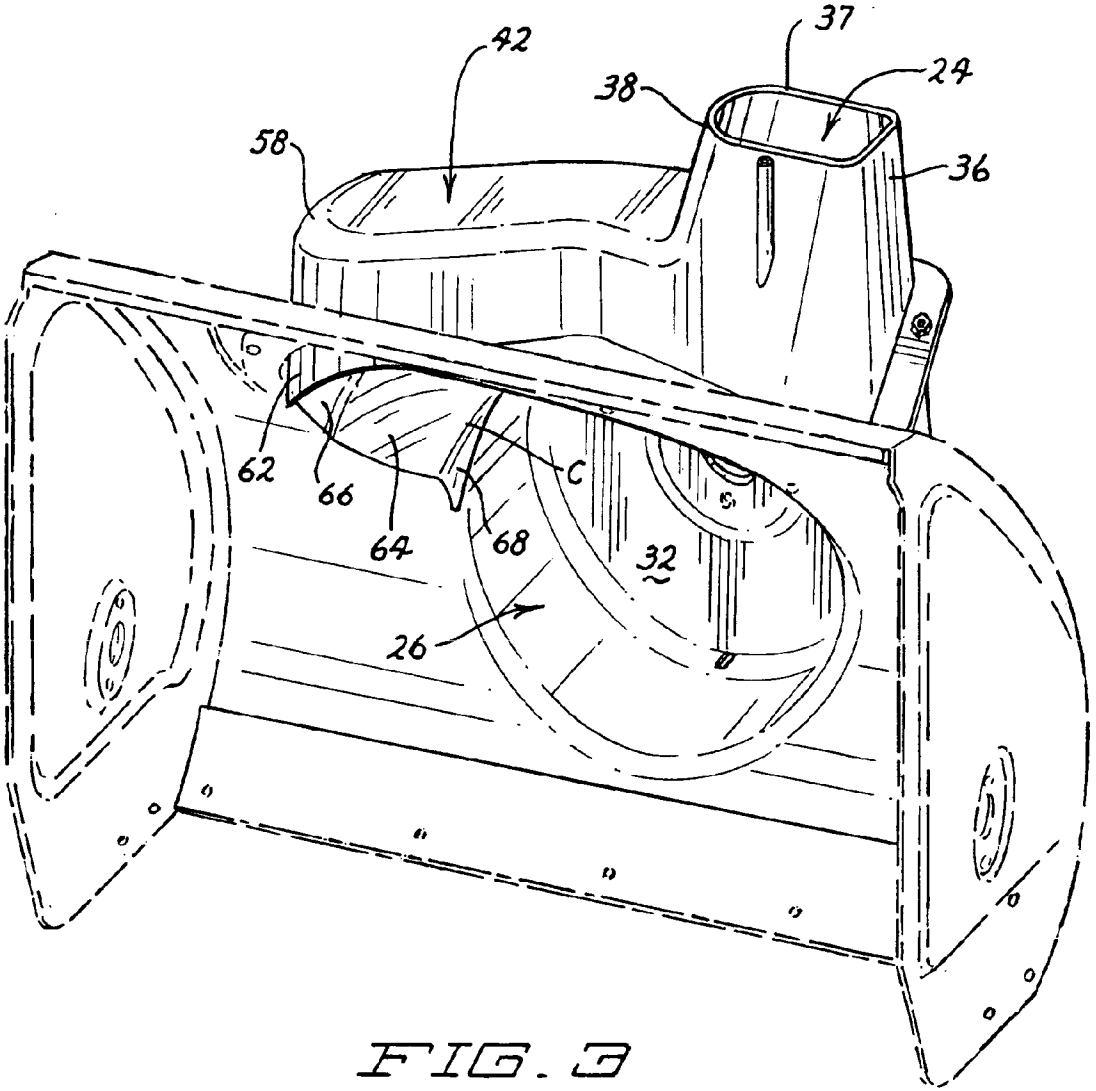
FIG. 9 is a diagrammatic view similar to FIG. 8, but illustrating the operation of the snow discharge pipe of a prior art two stage snowthrower without the impeller housing bypass member.

Referring first to FIG. 9, when looking at an impeller housing 26 of a conventional prior art two stage snowthrower in a front elevational view, impeller housing 26 has a circular cross-section 34 having a nominal diameter d that is slightly larger than the diameter of impeller 20. Within circular cross-section 34 of impeller housing 26, the tips of impeller blades 22 pass close to the wall that forms circular cross-section 34. As impeller 20 rotates around within circular cross-section 34 of impeller housing 26 as indicated by arrow D, blades 22 of impeller 20 each reach a position where snow can be thrown upwardly off blades 22. This is about at the position where each blade 22 becomes horizontal and is moving upwardly.

Traditionally, at the position where the snow releases from impeller blades 22, impeller housing 26 is merged with snow discharge pipe 24 along a first edge b such that the snow can pass upwardly through snow discharge pipe 24. As shown in FIG. 9, a first side wall 36 of snow discharge pipe 24 joins to circular cross-section 34 of impeller housing 26 along first edge b and extends upwardly along a tangent to the circular orbit of the tips of blades 22. Also as shown in FIG. 9, a second side wall 38 of snow discharge pipe 24 extends generally straight down to rejoin circular cross-section 34 of impeller housing 26 along a second edge c. The first and second edges b and c indicate where the first and second side walls 36 and 38 of snow discharge pipe 24 join circular cross-section 34 of impeller housing 26. The edges b and c are represented in FIG. 9 by points lying along the edges b and c, the complete edges b and c not being shown in the two-dimensional view of FIG. 9.

In conventional prior art two stage snow-thrower as shown in FIG. 9, snow being circulated within impeller housing 26 can leave impeller housing 26 only by travelling upwardly through snow discharge pipe 24 as indicated by the arrow A in FIG. 9. A small portion of the snow might recirculate within impeller housing 26 as indicated by the arrow B. However, snow discharge pipe 24 is the only exit intentionally provided in impeller housing 26 for the snow, disregarding any snow that might recirculate within the path B or might inadvertently spit back out through circular inlet 30 to impeller housing 26.

Figure 8:
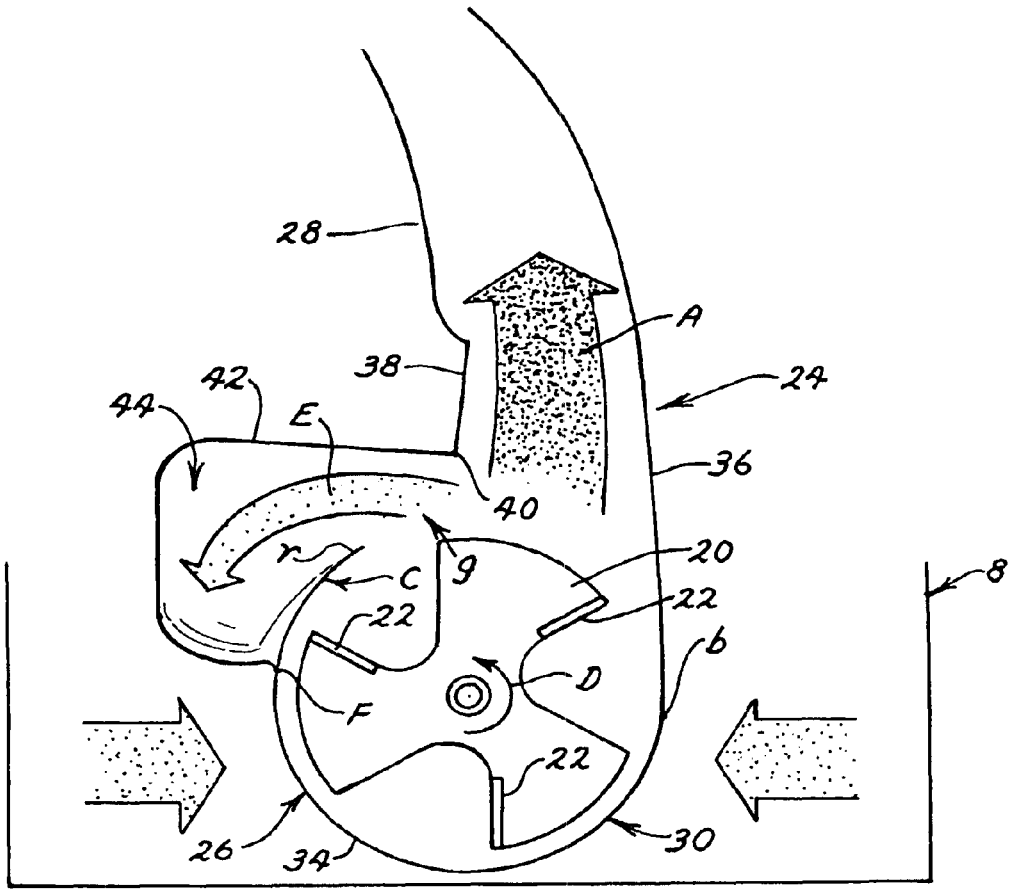
FIG. 8 is a diagrammatic view representing the operation of the snow discharge pipe and impeller housing bypass member of the snowthrower shown in FIG. 1.
Figure 9:
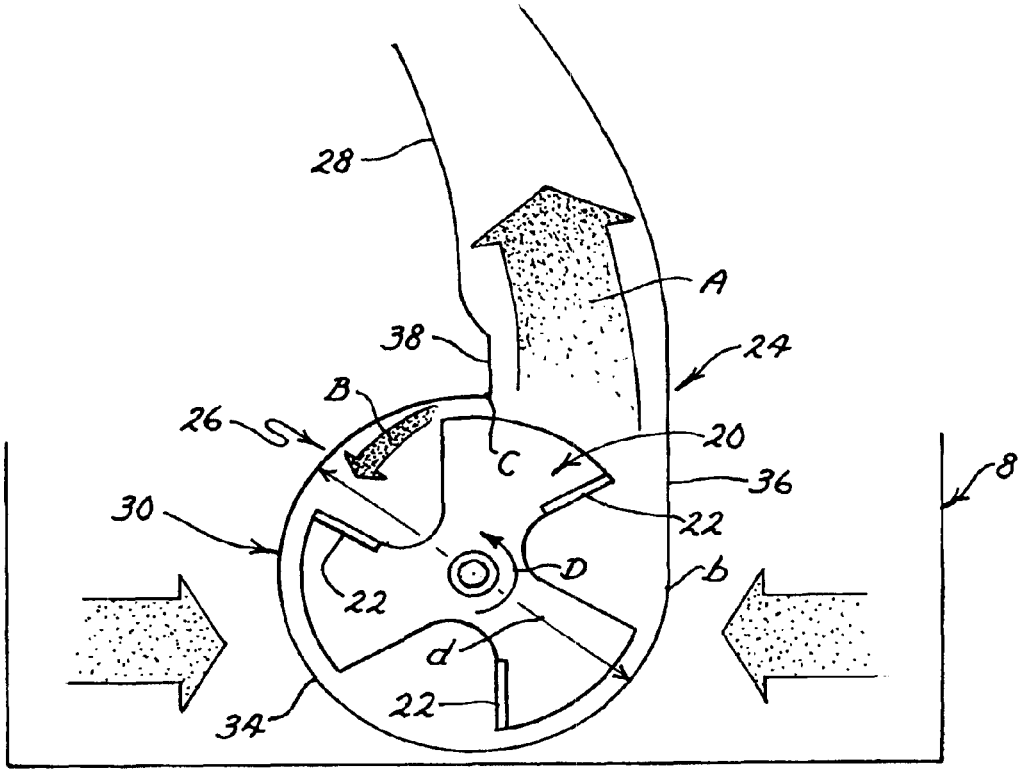
FIG. 9 PRIOR ART

Referring now to FIG. 8, in snowthrower 2 of this invention, the edge c where circular cross-section 34 of impeller housing 26 resumes after being interrupted by snow discharge pipe 24 is shifted from its normal location where it usually joins to the lower edge 40 of second side wall 38 of snow discharge pipe 24. Referring now to FIG. 8, in this invention, the edge c where circular cross-section 34 of impeller housing 26 resumes is now displaced laterally and below lower edge 40 of second side wall 38 of snow discharge pipe 24. This opens up a gap referred to as g in FIG. 8 between lower edge 40 of second side wall 38 of snow discharge pipe 24 and the edge c where circular cross-section 34 of impeller housing 26 resumes. The edge c is angled laterally outwardly and inclined downwardly relative to lower edge 40 such that edge c can be seen along its length even in the two dimensional views of FIGS. 4 and 8.

The gap g is quite substantial in size. For example, the rearward end r of edge c is displaced approximately 3 inches vertically and 4 inches laterally from the lower edge 40 of second side wall 38. The forward end f of edge c is displaced approximately 6 inches vertically and 6 inches laterally from the lower edge 40 of second side wall 38.

An impeller housing bypass member 42 forms a bypass passage 44 that connects gap g back to the interior of auger housing 8 to allow any snow passing through gap g to be deposited back into auger housing 8 to be picked up again, as indicated by the arrow E in FIG. 8. This bypassed snow will be picked up by auger 10 again, directed back to impeller housing 26, and will be rethrown by impeller 20 as impeller 20 rotates in the direction of arrow D in FIG. 8. Most snow will be thrown upwardly through snow discharge pipe 24 the first time through impeller housing 26. However, it is probable that at least some snow will miss snow discharge pipe 24, pass through gap g and bypass passage 44, and pass back into auger housing 8.

Opening up impeller housing 26 beneath second side wall 38 of snow discharge pipe 24 to provide the aforementioned gap g allows recirculation of the snow to auger housing 8 when gap g is connected back to auger housing 8 by bypass passage 44. It also provides an extra relief or space beneath snow discharge pipe 24 that is useful in clearing snow plugs within snow discharge pipe 24. To further assist in this plug clearing action, the second side wall 38 and front wall 35 of snow discharge pipe 24 are preferably tapered outwardly by about 5–10° as they extend downwardly. First side wall 36 and rear wall 37 of snow discharge pipe 24 are also tapered outwardly as they extend downwardly but by a smaller amount, by about 2°. By contrast, in many prior art snowthrowers, the walls 35–38 of snow discharge pipe 24 are generally vertical, as indicated diagrammatically in FIG. 9 by the side walls 36 and 38.

When snowthrower 2 is provided with gap g between snow discharge pipe 24 and impeller housing 26, a snow plug can be easily cleared from snow discharge pipe 24 from behind handle assembly 6. All the user need do is to push down on handle assembly 6 to raise the front end of snow-thrower 2 off the ground. While keeping auger 8 and impeller 20 operating, the user can then let the front end of snowthrower 2 fall or bump back down into engagement with the ground. This process may need to be repeated a couple of times.

At some point in this process of bumping the front end of snowthrower 2 on the ground, a snow plug that has formed in snow discharge pipe 24 will begin to slide or fall back down out of snow discharge pipe 24 because enough room is provided in gap g to readily let the snow plug begin moving downwardly. This downward movement is also facilitated by the tapered walls of snow discharge pipe 24, particularly the tapered front wall 35 and second side wall 38. When the snow plug begins to fall back down out of snow discharge pipe 24, the rotating impeller 20, which has been kept in operation by the user, will quickly break the plug up and recirculate it within impeller housing 26 or deposit it back in auger housing 8. Once snow discharge pipe 24 has been cleared of the plug, the broken up snow that had formed the plug will be thrown back up through snow discharge pipe 24 by impeller 20.

Consequently, the user need no longer use a stick or other implement to break up the snow plug into smaller pieces in order to clear the plug. Instead, the user can remain behind handle assembly 6 and clear snow plugs without leaving the normal operator's position and without shutting off the engine. This is a major time savings for the user and obviates a source of frustration in using two stage snowthrowers. Moreover, there is little risk that any type of implement that might ever be used could become jammed between impeller blade 22 and edge c.

Preferably, snow discharge pipe 24 and impeller housing bypass member 42 are formed as a single piece as shown in FIGS. 1–7. Impeller housing bypass member 42 extends laterally and forwardly from second side wall 38 of snow discharge pipe 24. Together, snow discharge pipe 24 and impeller housing bypass member 42 form what looks much like a boot with the toe of the boot sticking to one side. See FIGS. 5 and 6. Snow discharge pipe 24 and impeller housing bypass member 42 may be molded as a single piece from plastic and provided with attachment flanges 48 for allowing snow discharge pipe 24 and impeller housing bypass member 42 to be bolted to the top of auger housing 8 and impeller housing 26. See FIG. 2.

Figure 10:
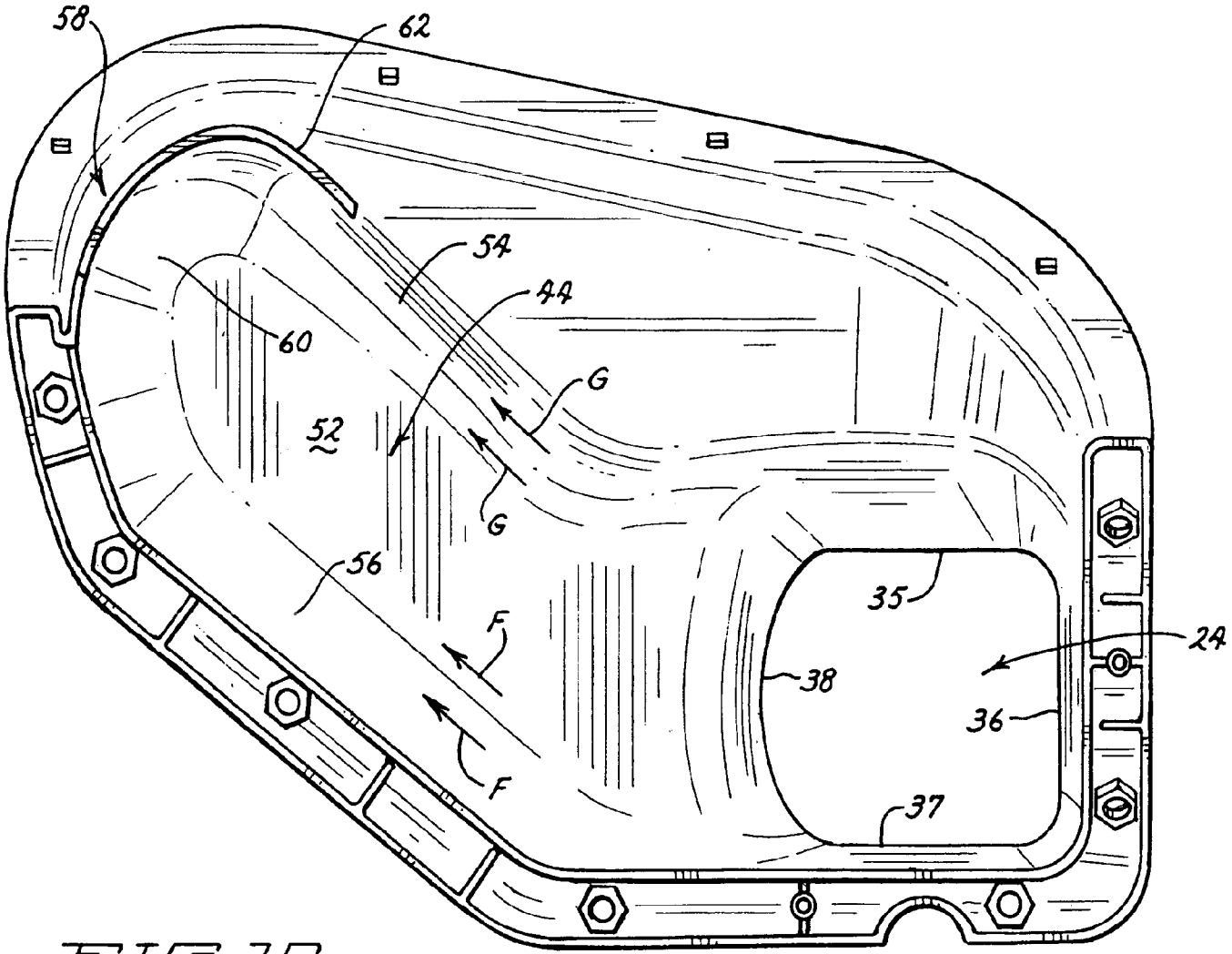
FIG. 10 is a bottom plan view of the snow discharge pipe and impeller housing bypass member of the snow-thrower shown in FIG. 1, particularly illustrating the bypass passage.

Impeller housing bypass member 42 has a generally U-shaped downwardly facing bypass passage 44 that connects gap g to a bypass exit 50 in back wall 11 of auger housing 8. Referring to FIGS. 4 and 10, bypass passage 44 has a top wall 52, a front wall 54 and a rear wall 56. Bypass passage 44 is angled forwardly so as to reach auger housing 8 from snow discharge pipe 24. The free or distal end 58 of bypass passage 44 is closed off by an arcuate end wall 60. Arcuate end wall 60 has a front downwardly protruding or extending lower lip 62. See FIGS. 3 and 4 which show lower lip 62.

A fixed baffle or ramp 64 is provided in bypass exit 50 in back wall 11 of auger housing 8. Ramp 64 curves inwardly and downwardly relative to impeller housing bypass member 42 to help guide snow from bypass passage 44 into auger housing 8. Ramp 64 has an upwardly protruding outer flange 66 that tucks up behind lower lip 62 and rear wall 56 of impeller housing bypass member 42 and a downwardly protruding inner flange 68 that wraps over edge c where circular cross-section 34 of impeller housing 26 resumes. See FIG. 3. When snow discharge pipe 24 and impeller housing bypass member 42 are secured in place, lower lip 62 of impeller housing bypass member 42 fits or sticks slightly down through bypass exit 50 in back wall 11 as shown in FIGS. 3 and 4. Lower lip 62 when in place as shown in FIGS. 3 and 4 extends or curves down at the bottom to help catch snow and prevent snow from spitting forwardly.

Any snow being directed through bypass passage 44 formed in impeller housing bypass member 42 will either fall out onto the downwardly and inwardly sloped ramp 64 as such snow moves along bypass passage 44 or will be discharged from bypass passage 44 as such snow reaches end wall 60 of bypass passage 44, thereby to be dumped back into auger housing 8. In this respect, most fast moving snow will tend to ride along the junction between top wall 52 and rear wall 56 or on adjoining portions of top wall 52 and rear wall 56 as indicated by the arrows F in FIG. 10 until the snow reaches end wall 60 and gets directed by end wall 60 and lower lip 62 into auger 10. Lower lip 62 is located ahead of ramp 64 to discharge snow directly to auger 10. This fast moving snow thus exits smoothly and cleanly from bypass passage 44 to be effectively deposited back in auger housing 8 for contact by auger 10.

Figure 11:
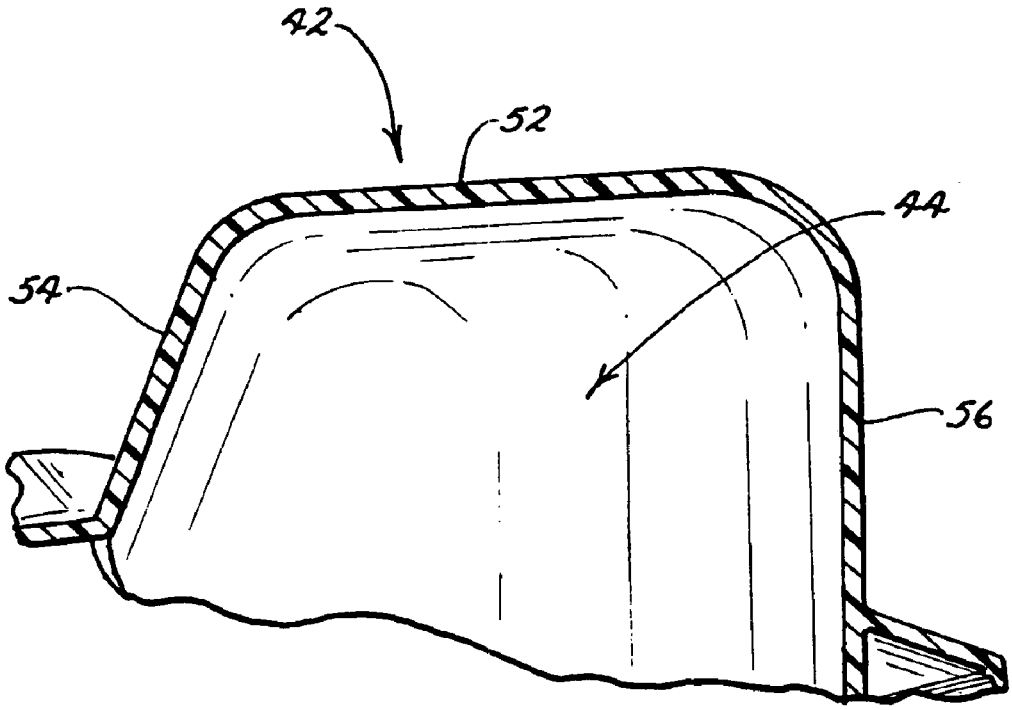
FIG. 11 is a cross-sectional view through the bypass passage of the impeller housing bypass member taken along lines 11—11 in FIG. 2, particularly showing the different angles of inclinations of the front and rear walls of the bypass passage.

Slower moving snow, if any, might ride more against front wall 54 of bypass passage 44 rather than against rear wall 56 as indicated by the arrows G in FIG. 10. However, as shown in FIG. 11, front wall 54 of bypass passage 44 is more angled and less steep than rear wall 56. This permits slower moving snow travelling along front wall 54 to more easily fall off front wall 54 and down onto ramp 64 without sticking to or clogging front wall 54. Ramp 64 is angled downwardly to permit any snow falling onto ramp 64 to slide down into auger housing 8.

Preferably, in snowthrower 2 of this invention, the top of snow discharge pipe 24 is approximately 6 to 8 inches above the top of impeller 20, or much further above the top of impeller 20 than the 2 to 3 inches in most prior art two stage snowthrowers. This also lessens the risk of any objects or tools inserted down through snow discharge pipe 24 into impeller housing 26 from being jammed against edge c by impeller blades 22.

Various modifications of this invention will be apparent to those skilled in the art. For one thing, an impeller housing bypass member 42 formed in some other manner could be used. Moreover, impeller housing bypass member 42 need not necessarily dump snow back into auger housing 8, though this is obviously preferred. Instead, impeller housing bypass member could be directed to deposit any bypassed snow back in front of auger housing 8 or even to one side of auger housing 8. Moreover, while it is preferred that snow discharge pipe 24 have outwardly tapered front and side walls 35 and 38 as such walls extend downwardly, gap g is useful in clearing plugs even when the walls of snow discharge pipe 24 are vertically straight. Thus, the scope of this invention is to be limited only by the appended claims.

We claim:

1. A two stage snowthrower, which comprises:

(a) an auger housing having a transversely extending auger for gathering snow lying on the ground;

(b) a cylindrical impeller housing behind the auger housing with the impeller housing having a circular cross-section, the impeller housing carrying a rotatable impeller for receiving snow from the auger and for throwing snow vertically upwardly in a snow stream;

(c) a snow discharge pipe on top of the impeller housing for receiving the snow stream from the impeller and for delivering the snow stream to a chute carried on top of the snow discharge pipe; and (d) wherein the circular cross-section of the impeller housing is joined to a first side wall of the snow discharge pipe along a first edge such that the circular cross-section of the impeller is interrupted along a first edge, and wherein the circular cross-section of the impeller housing resumes at a second edge which second edge is separated by a gap from a lower edge of a second side wall of the snow discharge pipe.

2. The snowthrower of claim 1, wherein the second edge is displaced laterally from the lower edge of the second side wall of the snow discharge pipe.

3. The snowthrower of claim 1, wherein the second edge is displaced vertically below the lower edge of the second side wall of the snow discharge pipe.

4. The snowthrower of claim 1, wherein the second edge is displaced both laterally from and vertically below the lower edge of the second side wall of the snow discharge pipe.

5. The snowthrower of claim 1, wherein at least the second side wall of the snow discharge pipe tapers outwardly as it extends downwardly to connect to the impeller housing.

6. The snowthrower of claim 5, wherein both the second side wall and a front wall of the snow discharge pipe taper outwardly as they extend downwardly to connect to the impeller housing.

7. The snowthrower of claim 1, wherein at least a front wall of the snow discharge pipe tapers outwardly as it extends downwardly to connect to the impeller housing.

8. The snowthrower of claim 1, further including a bypass member connecting the gap back to the auger housing, the bypass member having a bypass passage for allowing snow passing through the gap and not through the snow discharge pipe to be recirculated back to the auger housing to be picked up by the auger and impeller again.

9. The snowthrower of claim 8, wherein the snow discharge pipe and bypass member are formed as a single piece.

10. The snowthrower of claim 8, wherein the bypass member extends laterally from the second side wall of the snow discharge pipe.

11. The snowthrower of claim 10, wherein the bypass member further extends forwardly relative to the snow discharge pipe to connect to the auger housing.

12. The Snowthrower of claim 11, further including a downwardly facing bypass passage formed in the laterally and forwardly extending bypass member for conducting snow from the gap back to a bypass exit in the auger housing.

13. The snowthrower of claim 12, further including a downwardly and inwardly curved ramp in the bypass exit in the auger housing with the ramp underlying at least a portion of the bypass member to help guide snow from the bypass passage back into the auger housing.

14. A two stage snowthrower, which comprises:

(a) an auger rotating within an auger housing having an open front, the auger shaped for feeding snow into an impeller housing;

(b) an impeller rotating within a circular cross-section of the impeller housing for throwing snow upwardly through a snow discharge pipe; and (c) a gap between a lower edge of a second side wall of the snow discharge pipe and the circular cross-section of the impeller housing for allowing some snow to bypass the snow discharge pipe and not be thrown therethrough.

15. The snowthrower of claim 14, further including a bypass member for connecting the gap to the auger housing for recirculating snow not thrown through the snow discharge pipe back to the auger housing.

16. The snowthrower of claim 14, wherein the snowthrower is a walk behind Snowthrower having an upwardly and rearwardly extending handle assembly.

17. A two stage snowthrower, which comprises:

(a) a transversely extending auger housed within an auger housing;

(b) a generally cylindrical impeller housing extending rearwardly from a rear wall of the auger housing;

(c) a rotatable impeller within the impeller housing, wherein the impeller rotates within a circular cross-section of the impeller housing to throw snow upwardly through a snow discharge pipe attached to a top of the impeller housing, wherein the snow discharge pipe has a first side wall and a second side wall;

(d) wherein the first side wall of the snow discharge pipe is joined to the circular cross-section of the impeller housing at a first edge where snow is thrown upwardly by blades of the impeller, the circular cross-section of the impeller housing resuming at a second edge which is displaced laterally and vertically below a lower edge of the second side wall of the snow discharge pipe.

18. A snowthrower, which comprises:

(a) an impeller housing having a substantially open front side, a generally cirumferential peripheral wall, and a back wall which together define a snow receiving cavity with snow entering the cavity through the open front side of the impeller housing;

(b) a rotatable snow throwing impeller situated within the cavity in front of the back wall, the impeller having at least one blade with a tip that sweeps along and past the peripheral wall as the impeller rotates within the cavity in a predetermined direction of rotation;

(c) a first snow exit in the peripheral wall of the impeller housing leading to a generally vertical snow discharge path; and (d) a second snow exit in the peripheral wall of the impeller housing, the second snow exit being positioned downstream of the first snow exit taken with respect to the direction of rotation of the impeller.

19. The snowthrower of claim 18, wherein the impeller housing is located behind a snow collecting housing with the open front side of the impeller housing being situated in a rear wall of the snow collecting housing.

20. The snowthrower of claim 19, wherein the snow collecting housing includes a rotatable snow gathering auger.

21. The snowthrower of claim 19, wherein the second snow exit leads to the snow collecting housing to recirculate any snow passing through the second snow exit back to the snow collecting housing.

22. The snowthrower of claim 19, wherein the snow collecting housing includes a rotatable snow gathering auger.

23. A snowthrower, which comprises:

(a) an impeller housing having a snow receiving cavity with snow entering the cavity through an open front side of the impeller housing;

(b) a rotatable snow throwing impeller situated within the cavity of the impeller housing;

(c) a snow collecting housing situated in front of the impeller housing with the open front side of the impeller housing receiving snow collected by the snow collecting housing;

(d) a first snow exit in the impeller housing leading to a generally vertical snow discharge path; and (d) a second snow exit in the impeller housing which second snow exit is separate from both the open front side of the impeller housing and the first snow exit, and wherein the second snow exit leads to the snow collecting housing to recirculate any snow passing through the second snow exit back to the snow collecting housing.

* * * * *